US011814199B2

(12) United States Patent
Ford

(10) Patent No.: US 11,814,199 B2
(45) Date of Patent: Nov. 14, 2023

(54) PACKAGING SYSTEM

(71) Applicant: Graphic Packaging International, LLC, Atlanta, GA (US)

(72) Inventor: Colin P. Ford, Woodstock, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 199 days.

(21) Appl. No.: 16/532,844

(22) Filed: Aug. 6, 2019

(65) Prior Publication Data

US 2019/0359361 A1 Nov. 28, 2019

Related U.S. Application Data

(62) Division of application No. 15/166,782, filed on May 27, 2016, now Pat. No. 10,414,528.

(Continued)

(51) Int. Cl.
*B65B 5/08* (2006.01)
*B65B 39/00* (2006.01)

(Continued)

(52) U.S. Cl.
CPC ..... *B65B 21/06* (2013.01); *B65B 5/06* (2013.01); *B65B 5/068* (2013.01); *B65B 5/08* (2013.01);

(Continued)

(58) Field of Classification Search
CPC ... B65B 43/126; B65B 43/265; B65B 43/305; B65B 43/345; B65B 21/242; B65B 5/08;

(Continued)

(56) References Cited

U.S. PATENT DOCUMENTS 1,351,461 A 8/1920 Beckmann
2,577,529 A 12/1951 Kerr (Continued)

FOREIGN PATENT DOCUMENTS

DE 3529657 2/1987
DE 42 16 671 9/1993

(Continued)

OTHER PUBLICATIONS

European Search Report for EP 20 19 5299 dated Jan. 12, 2021.
International Search Report and Written Opinion for PCT/2016/034616 dated Sep. 7, 2016.

(Continued)

*Primary Examiner* — Gloria R Weeks
(74) *Attorney, Agent, or Firm* — WOMBLE BOND DICKINSON (US) LLP

(57) ABSTRACT

A method of loading articles in cartons. The method can comprise moving a carton in a generally flat configuration in a downstream direction with a carton opening carousel, at least partially opening the carton while moving the carton with the carton opening carousel, and transferring the carton from the carton opening carousel to a carton loading carousel in a transfer region. The transferring the carton can comprise moving the carton in an upstream direction. The method further can comprise loading a plurality of articles into the carton while moving the carton in a downstream direction with the carton loading carousel.

7 Claims, 10 Drawing Sheets

Related U.S. Application Data

(60) Provisional application No. 62/230,186, filed on May 29, 2015.

(51) Int. Cl.

| | |
|---|---|
| ***B65B 43/26*** | (2006.01) |
| ***B65B 21/06*** | (2006.01) |
| ***B65B 5/06*** | (2006.01) |
| ***B65B 43/30*** | (2006.01) |
| ***B65B 43/50*** | (2006.01) |
| ***B65B 21/18*** | (2006.01) |
| ***B65B 21/24*** | (2006.01) |
| ***B65B 43/12*** | (2006.01) |
| ***B65B 43/34*** | (2006.01) |
| ***B65B 43/52*** | (2006.01) |
| ***B65B 43/60*** | (2006.01) |
| ***B65B 65/00*** | (2006.01) |

(52) U.S. Cl.

CPC ..... *B65B 21/18* (2013.01); *B65B 21/183* (2013.01); *B65B 21/242* (2013.01); *B65B 39/006* (2013.01); *B65B 43/126* (2013.01); *B65B 43/265* (2013.01); *B65B 43/305* (2013.01); *B65B 43/34* (2013.01); *B65B 43/50* (2013.01); *B65B 43/52* (2013.01); *B65B 43/60* (2013.01); *B65B 65/003* (2013.01)

(58) Field of Classification Search

CPC ..... B65B 43/26; B65B 39/006; B31B 50/58; B31B 50/76; B31B 50/78; B31B 50/782; B31B 50/786; B31B 50/787; B31B 50/804; B31B 50/81

USPC ..... 53/458, 564, 247, 566; 493/309, 310, 493/316, 318, 319

See application file for complete search history.

(56) References Cited

U.S. PATENT DOCUMENTS 2,701,085 A 2/1955 Davis
2,753,673 A * 7/1956 Olive ..... B65B 39/006 53/247
2,757,498 A 8/1956 Meyer-Jagenberg et al.
2,780,148 A 2/1957 Pearson et al.
2,909,874 A * 10/1959 Barr ..... B65B 43/265 53/75
2,921,425 A 1/1960 Seval
3,041,805 A 7/1962 Fulco
3,057,267 A 10/1962 Johnson, Jr.
3,091,903 A 6/1963 Kammerer
3,249,025 A 5/1966 Monroe
3,283,471 A 11/1966 Thurston et al.
3,293,998 A 12/1966 Farnow
3,368,766 A 2/1968 Livingston
3,415,033 A 12/1968 Perry et al.
3,431,703 A 3/1969 Miller
3,481,108 A 12/1969 Englander et al.
3,491,506 A 1/1970 Shiverdecker et al.
3,521,427 A 7/1970 Masch
3,592,003 A 7/1971 Stichhan
3,613,526 A 10/1971 Jones
3,645,068 A * 2/1972 Langen ..... B65B 5/08 53/566
3,698,151 A 10/1972 Arneson
3,698,154 A 10/1972 Woodruff
3,751,872 A 8/1973 Helms
3,783,752 A 1/1974 Langen et al.
3,848,519 A 11/1974 Ganz
3,864,894 A * 2/1975 Sheetz ..... B65B 43/30 53/506
3,911,799 A 10/1975 Klund
3,940,907 A 3/1976 Ganz
3,990,572 A 11/1976 Fishback
4,000,687 A 1/1977 Adams
4,047,362 A * 9/1977 Lister ..... B65B 43/14 53/385.1
4,055,943 A 11/1977 Reichert
4,064,675 A 12/1977 Stapp et al.
4,093,063 A 6/1978 Calvert et al.
4,100,715 A 7/1978 Ganz
4,170,929 A 10/1979 McDowell
4,171,603 A * 10/1979 Wiseman ..... B65B 39/006 53/248
4,207,721 A 6/1980 Raudat et al.
4,211,153 A 7/1980 Walters et al.
4,215,521 A * 8/1980 Hartness ..... B65B 39/006 53/248
4,332,123 A 6/1982 Calvert
4,389,832 A 6/1983 Calvert
4,391,078 A 7/1983 Nigrelli
4,439,974 A * 4/1984 Wiseman ..... B65B 39/006 53/248
4,481,752 A 11/1984 Sabel
4,530,198 A 7/1985 Le Bras
4,537,587 A 8/1985 Langen
4,570,413 A 2/1986 Raudat
4,589,245 A * 5/1986 Kroeber ..... B65B 39/006 53/248
4,596,544 A 6/1986 Hull
4,608,804 A * 9/1986 Wild ..... B65B 39/006 53/248
4,633,643 A * 1/1987 Wood ..... B65B 39/006 53/248
4,802,324 A 2/1989 Everson
4,871,348 A 10/1989 Konaka
4,878,337 A 11/1989 Raudat et al.
4,947,617 A 8/1990 Focke et al.
4,949,531 A 8/1990 Lagenbeck et al.
4,982,556 A 1/1991 Tisma
5,024,042 A * 6/1991 Meyer ..... B65B 43/28 53/252
5,061,231 A 10/1991 Dietrich et al.
5,155,968 A 10/1992 Mosse et al.
5,212,930 A * 5/1993 Raudat ..... B65B 5/08 53/247
5,212,932 A * 5/1993 Raudat ..... B65B 39/006 53/247
5,237,801 A 8/1993 Hillam et al.
5,241,805 A 9/1993 Johnson
5,323,587 A * 6/1994 Amaranti ..... B65B 35/52 53/157
5,381,639 A 1/1995 Calvert et al.
5,392,587 A * 2/1995 Crouch ..... B65B 39/006 53/248
5,411,464 A 5/1995 Calvert et al.
5,454,211 A 10/1995 Ziegler
5,544,738 A * 8/1996 Klopfenstein ..... B65G 17/26 198/626.5
5,558,489 A 9/1996 Moncrief et al.
5,561,968 A 10/1996 Palmer
5,626,002 A 5/1997 Ford et al.
5,630,311 A 5/1997 Flix
5,653,088 A * 8/1997 Cline ..... B65B 39/006 29/453
5,657,610 A 8/1997 Dietrich
5,671,587 A 9/1997 Robinson
5,784,857 A 7/1998 Ford et al.
5,809,746 A * 9/1998 DePuy ..... B65B 43/265 198/728
5,826,408 A 10/1998 Ford
5,979,147 A 11/1999 Reuteler
6,050,063 A 4/2000 Ford et al.
6,058,679 A 5/2000 Ziegler et al.
6,240,707 B1 6/2001 Ford et al.
6,282,871 B1 * 9/2001 Killinger ..... B65B 43/123 53/469
6,499,280 B1 12/2002 Tsutsui
6,550,608 B1 4/2003 Brown et al.
6,571,532 B1 * 6/2003 Wiernicki ..... B65B 21/183 414/225.01

(56) References Cited

U.S. PATENT DOCUMENTS

| | | | | |
|---|---|---|---|---|
| 6,637,174 | B1 * | 10/2003 | Dietrich | B65B 35/40 53/251 |
| 6,695,570 | B2 | 2/2004 | Ford et al. | |
| 6,722,101 | B2 | 4/2004 | Hartness et al. | |
| 6,748,725 | B2 | 6/2004 | Hartness et al. | |
| 6,907,979 | B2 | 6/2005 | Ford et al. | |
| 6,968,668 | B1 * | 11/2005 | Dimario | B65B 5/106 53/242 |
| 6,993,889 | B2 | 2/2006 | Ford | |
| 7,104,027 | B2 | 9/2006 | Ford et al. | |
| 7,392,630 | B2 | 7/2008 | Ford | |
| 7,401,453 | B2 | 7/2008 | Ford | |
| 7,631,474 | B2 | 12/2009 | Ford | |
| 7,779,606 | B2 | 8/2010 | Ford | |
| 9,415,915 | B2 | 8/2016 | Spivey, Sr. et al. | |
| 9,617,021 | B2 * | 4/2017 | McCorkle | B65B 25/02 |
| 9,868,554 | B2 * | 1/2018 | Grappoli | B65B 21/18 |
| 10,414,528 | B2 | 9/2019 | Ford | |
| 2003/0232709 | A1 | 12/2003 | Ronchi | |
| 2004/0000121 | A1 | 1/2004 | Ichikawa | |
| 2004/0031236 | A1 * | 2/2004 | Boix Jaen | B65B 43/265 53/48.8 |
| 2004/0226270 | A1 * | 11/2004 | Smith | B65B 43/305 53/566 |
| 2006/0042188 | A1 | 3/2006 | Ford | |
| 2006/0183616 | A1 * | 8/2006 | Fulkerson | B31B 50/00 493/51 |
| 2006/0207220 | A1 * | 9/2006 | Ford | B65B 65/003 53/398 |
| 2007/0220836 | A1 * | 9/2007 | Reuteler | B31B 50/006 53/491 |
| 2008/0245035 | A1 | 10/2008 | Ford | |
| 2009/0093355 | A1 * | 4/2009 | Huang | B65B 43/265 493/309 |
| 2010/0281822 | A1 * | 11/2010 | Murray | B65B 39/007 53/64 |
| 2012/0011808 | A1 * | 1/2012 | Langen | B65B 43/265 53/235 |
| 2013/0161892 | A1 * | 6/2013 | Krueger | B31B 50/00 271/3.14 |
| 2013/0340393 | A1 * | 12/2013 | Benedetti | B65B 43/265 53/457 |
| 2014/0113787 | A1 * | 4/2014 | Aganovic | B31B 50/00 493/122 |
| 2014/0360136 | A1 * | 12/2014 | Barilli | B65B 39/001 53/457 |
| 2015/0119216 | A1 * | 4/2015 | Benterman | B65B 59/02 493/22 |
| 2015/0191264 | A1 | 7/2015 | Ford | |
| 2016/0001905 | A1 | 1/2016 | Baltes | |
| 2016/0107408 | A1 * | 4/2016 | Hutter | B65B 43/305 493/313 |
| 2016/0332758 | A1 * | 11/2016 | Grappoli | B65B 39/006 |
| 2016/0347488 | A1 * | 12/2016 | Ford | B65B 21/06 |
| 2017/0001752 | A1 * | 1/2017 | Ishikawa | B65B 43/265 |
| 2017/0152067 | A1 | 6/2017 | Nakamoto | |
| 2017/0313465 | A1 * | 11/2017 | Vistrom | B31B 50/786 |
| 2017/0327265 | A1 * | 11/2017 | Vistrom | B65B 43/08 |
| 2019/0202586 | A1 * | 7/2019 | Monti | B65B 43/265 |
| 2020/0140131 | A1 * | 5/2020 | Lunnemann | B65B 3/00 |

FOREIGN PATENT DOCUMENTS

| | | | |
|---|---|---|---|
| DE | 102 03 459 | | 7/2003 |
| EP | 0 388 606 | | 9/1990 |
| EP | 0 734 952 | A1 | 10/1996 |
| EP | 1 468 915 | B1 | 8/2007 |
| EP | 1 584 561 | B1 | 8/2008 |
| EP | 2 027 021 | B1 | 12/2010 |
| EP | 2 411 287 | B1 | 6/2013 |
| EP | 2 343 244 | A2 | 7/2013 |
| EP | 2 024 234 | B1 | 10/2013 |
| EP | 2 663 497 | B1 | 11/2014 |
| EP | 2 483 157 | B1 | 9/2015 |
| EP | 3 053 832 | A1 | 8/2016 |
| GB | 717 120 | A | 10/1954 |
| JP | 50-96392 | | 7/1975 |
| JP | 61-114 | | 1/1986 |
| JP | 3-85224 | | 4/1991 |
| JP | 4-115934 | | 4/1992 |
| WO | WO 97/25246 | | 7/1997 |
| WO | WO 99/14122 | | 3/1999 |
| WO | WO 03/064270 | A2 | 8/2003 |
| WO | WO 2007/136512 | A2 | 11/2007 |
| WO | WO 2013/045806 | A1 | 4/2013 |
| WO | WO 2013/066701 | A1 | 5/2013 |
| WO | WO 2015/038566 | A1 | 3/2015 |

OTHER PUBLICATIONS

Supplementary European Search Report for EP 16 80 4112 dated Apr. 12, 2019.
Office Action for U.S. Appl. No. 15/166,782 dated Jul. 27, 2018.
Response to Restriction Requirement for U.S. Appl. No. 15/166,782 dated Aug. 21, 2018.
Office Action for U.S. Appl. No. 15/166,782 dated Oct. 12, 2018.
Amendment A and Response to Office Action for U.S. Appl. No. 15/166,782 dated Dec. 31, 2018.
Office Action for U.S. Appl. No. 15/166,782 dated Jan. 30, 2019.
Request for Continued Examination (RCE) Transmittal for U.S. Appl. No. 15/166,782 dated Apr. 25, 2019.
Amendment B and Response to Final Office Action for U.S. Appl. No. 15/166,782 dated Apr. 25, 2019.
Notice of Allowance and Fee(s) Due for U.S. Appl. No. 15/166,782 dated May 31, 2019.
Issue Fee Transmittal Form for U.S. Appl. No. 15/166,782 dated Aug. 7, 2019.
Issue Notification for U.S. Appl. No. 15/166,782 dated Aug. 28, 2019.

* cited by examiner

PACKAGING SYSTEM

CROSS-REFERENCE TO RELATED APPLICATIONS

This application is a division of U.S. patent application Ser. No. 15/166,782, filed on May 27, 2016, which claims the benefit of U.S. Provisional Patent Application No. 62/230,186, filed on May 29, 2015.

INCORPORATION BY REFERENCE

The disclosures of U.S. patent application Ser. No. 15/166,782, which was filed on d May 27, 2016, U.S. Provisional Patent Application No. 62/230,186, which was filed on May 29, 2015, U.S. Pat. No. 6,240,707, which was issued Jun. 5, 2001, U.S. Pat. No. 7,392,630, which was issued Jun. 1, 2008, and U.S. Pat. No. 7,631,474, which was issued Dec. 15, 2009, are hereby incorporated by reference for all purposes as if presented herein in their entirety.

BACKGROUND OF THE DISCLOSURE

The present disclosure generally relates to packaging systems, machines, and/or equipment for loading beverage containers or other articles into cartons.

SUMMARY OF THE DISCLOSURE

In general, one aspect of the disclosure is directed to a method of loading articles in cartons. The method can comprise moving a carton in a generally flat configuration in a downstream direction with a carton opening carousel, at least partially opening the carton while moving the carton with the carton opening carousel, and transferring the carton from the carton opening carousel to a carton loading carousel in a transfer region. The transferring the carton can comprise moving the carton in an upstream direction. The method further can comprise loading a plurality of articles into the carton while moving the carton in a downstream direction with the carton loading carousel.

In another aspect, the disclosure is generally directed to a system for loading articles into cartons. The system can comprise a carton opening carousel for moving the cartons in a downstream direction. The carton opening carousel can have opening features for at least partially opening the cartons from a generally flat configuration. The system further can comprise a carton loading carousel for loading the articles into the cartons while moving the articles and the cartons in a downstream direction. A transfer region can be for transferring the cartons from the carton opening carousel to the carton loading carousel. The carton opening carousel and the carton loading carousel can cooperate to at least partially form the transfer region, and the carton opening carousel and the carton loading carousel can be configured for moving the cartons in an upstream direction in the transfer region.

In another aspect, the disclosure is generally directed to a guide assembly for at least partially opening and conveying a carton. The guide assembly can comprise a support and at least one guide arm mounted to the support. The at least one guide arm can comprise a tapered end and at least one flange extending obliquely from a central portion of the at least one guide arm. The tapered end can comprise an edge extending along at least a portion of the central portion and the at least one flange.

In another aspect, the disclosure is generally directed to a loading lug assembly for at least partially guiding an article into a carton. The loading lug assembly can comprise a mounting attachment for being mounted to a drive chain and a loading lug comprising a plurality of fingers extending from a common crossmember. The loading lug can be removably mounted to the mounting attachment. The fingers of the plurality of fingers and the crossmember can be flexible for moving at least the fingers at least partially away from one another to at least partially accommodate the article while guiding the article into the carton.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

Figure 1:
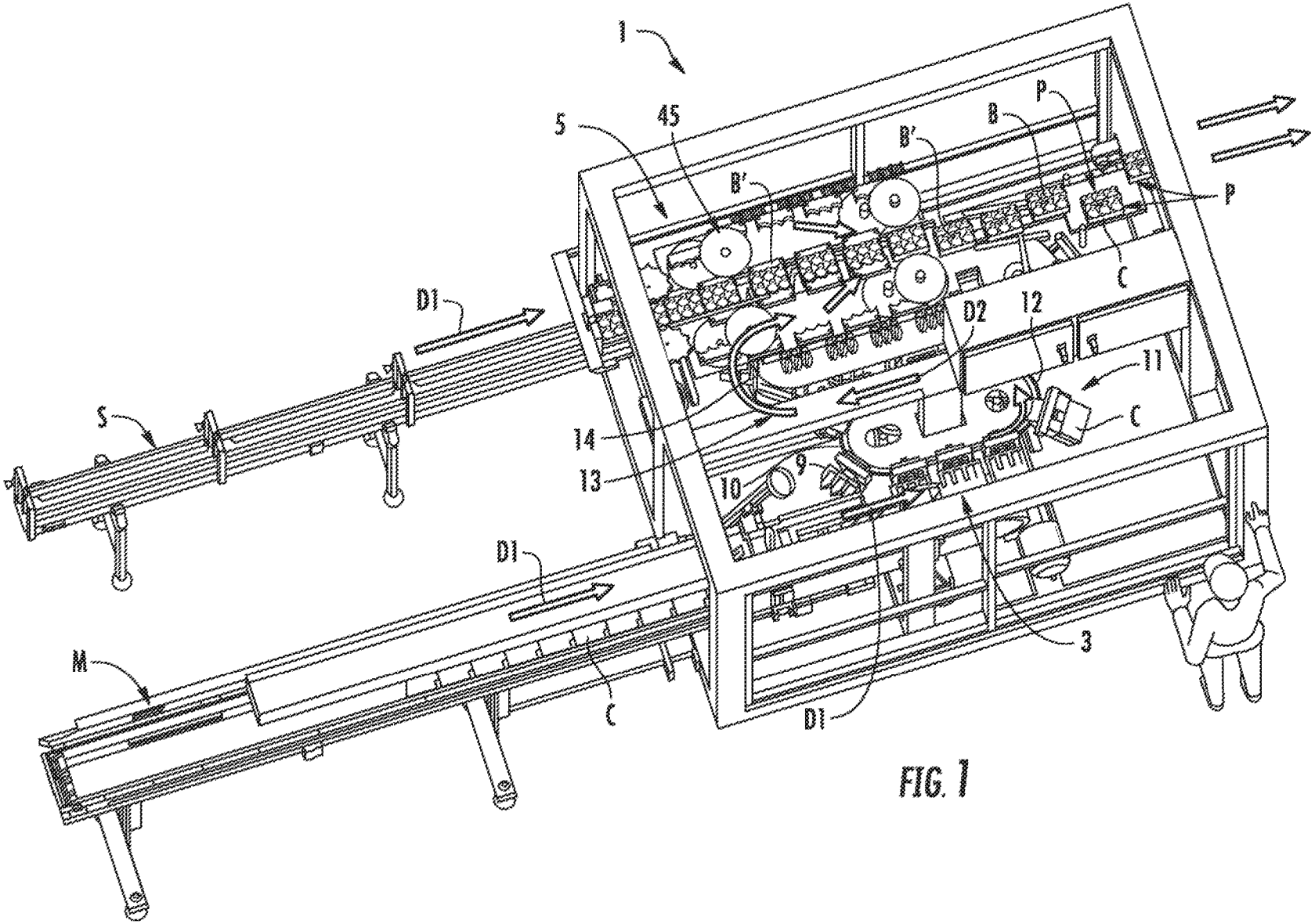
FIGS. 1 and 2 are schematic perspective views of a system for opening and loading cartons with bottles according to an exemplary embodiment of the disclosure.

The present disclosure generally relates to packing machines, components for packaging machines, and/or methods of packaging articles such as beverage containers or other suitable articles into cartons such as basket-style cartons. In one embodiment, the articles can be bottles (e.g., glass bottles), but the articles could be other types of beverage containers (e.g., cans) or other articles without departing from the disclosure. The articles can be used for packaging food and beverage products, for example. The articles can be made from materials suitable in composition for packaging the particular food or beverage item, and the materials include, but are not limited to, glass; aluminum and/or other metals; plastics such as PET, LDPE, LLDPE, HDPE, PP, PS, PVC, EVOH, and Nylon; and the like, or any combination thereof. Cartons according to the present disclosure can accommodate articles of any shape. For the purpose of illustration and not for the purpose of limiting the scope of the disclosure, the following detailed description describes packaging beverage containers (e.g., glass beverage bottles) in cartons (e.g., basket-style cartons).

In one embodiment, the packaging of articles such as bottles, cans, and other similar articles in cartons or other containers is a highly automated process, with conventional automated packaging equipment generally being run at high packaging speeds in order to maximize output. For example, in a typical packaging machine for packaging articles such as bottles, cans, and the like, articles to be packaged are fed into the packaging machine in a line or series of lines along an infeed conveyor, after which the articles are grouped together in various standard configurations or groupings, such as four, six, eight, twelve, or twenty-four pack configurations. The groups of articles are then packaged into a carton, such as a basket-style carton having an open top and individual compartments or cells for the respective beverage containers, or any other type of carton. The placement of the articles within the carton can be done in a variety of ways, depending upon the type of package in which the articles are to be placed. For example, the bottoms of cartons can be opened and the cartons then placed over selected groups of articles as the articles are moved along a transport path, or the carton can be moved upwardly relative to the groups of articles to receive the articles in the carton. U.S. Pat. Nos. 6,240,707; 7,392,630; and 7,631,474 generally relate to packaging systems, machines, components, and methods that have similar features of the present disclosure. The entire contents of U.S. Pat. Nos. 6,240,707; 7,392,630; and 7,631,474 are hereby incorporated by reference in their entirety for all purposes.

The high speed packaging system (e.g., dual carousel packaging system) of the present disclosure and discussed in detail below and as shown and described in the figures is shown and/or described as loading bottles B into cartons C to form packages P. The cartons C can be basket-style cartons having an open top T and individual cells for receiving respective containers B of a group of containers. In one embodiment, the cartons C have a central wall with a handle H (FIGS. 2, 3, 6A, 6B, and 11A-12B). The central wall can extend between a first (front) portion and a second (back) portion of the carton for receiving respective rows of articles (e.g., bottles B). The cartons also can include a front panel, a back panel, and end panels extending from the respective front and back panels to the central panel and divider flaps extending between the central panel and the respective front and back panels to form the individual cells (e.g., FIG. 11A). Further, the cartons can include an at least partially closed bottom with a base panel CB. In one embodiment, the base panel CB can be foldably connected to one of the front panel and the back panel of the carton and can be glued to a flap that is foldably connected to other one of the front and back panels to at least partially close the bottom of the carton. In the illustrated embodiment, the bottom panel CB can be glued to form the closed bottom of the carton before the carton is supplied to the system (e.g., the cartons can be fed to the system from a carton forming system (not shown) wherein the bottoms of the cartons are formed and/or the cartons can be formed separately and supplied to the packaging system in a magazine—FIGS. 2 and 3). In one embodiment, the cartons C can be configured to fold to a flat configuration where the front and back panels are folded against the central panel of the carton and the bottom panel is folded along a medial fold line. Additionally, the cartons C can be configured to fold to an open configuration where the front and back panels are disposed opposite to the central panel with the end panels extending across the ends of the carton and the base panel CB extending across the at least partially closed bottom of the carton.

Figure 2:
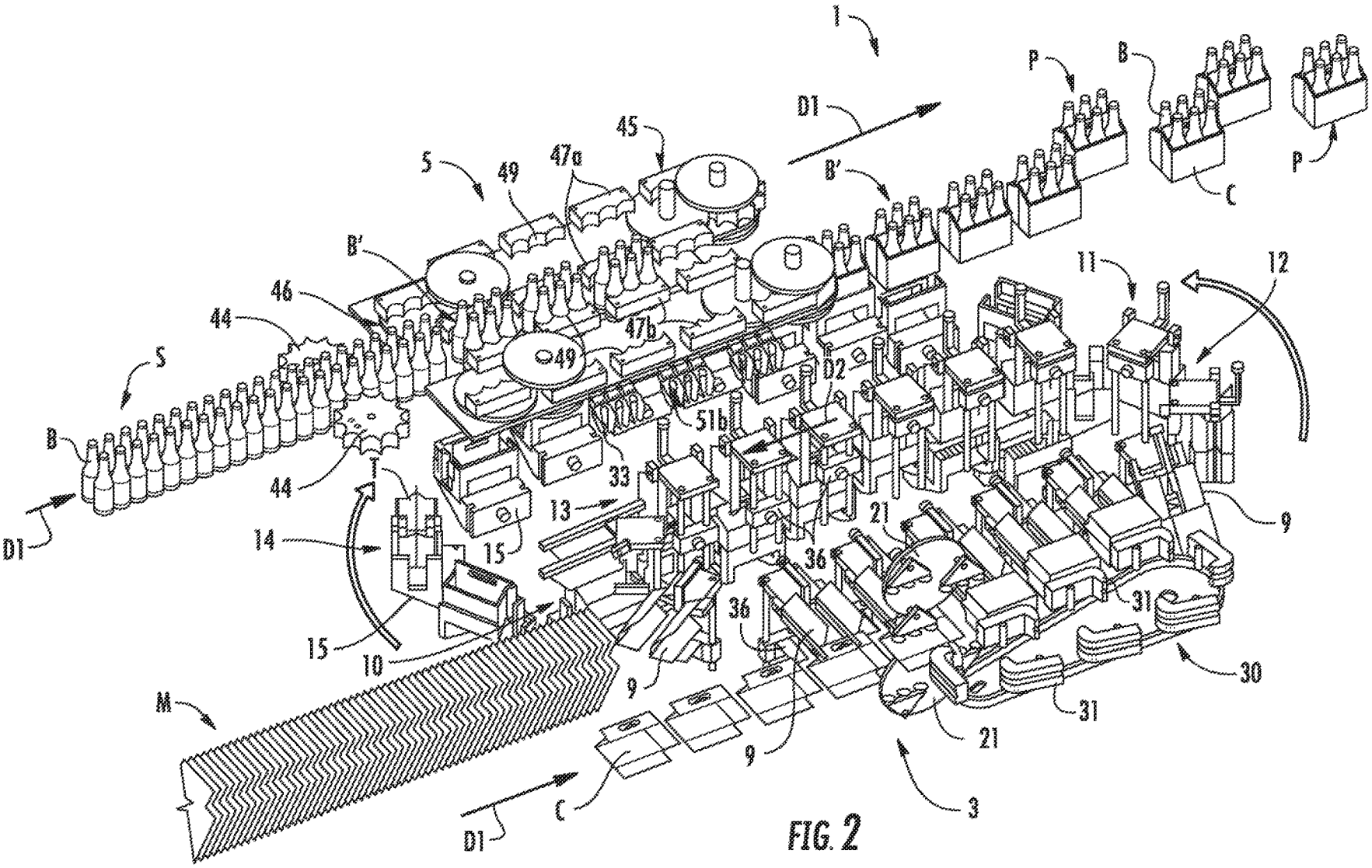

FIGS. 1 and 2 generally illustrate a dual carousel packaging system 1 with carton opening carousel 3 and a carton loading carousel 5. In the illustrated embodiment, the carton opening carousel 3 receives cartons C in the flat state from a stack of cartons or magazine M at an upstream end 10 of the carton opening carousel. The carton opening carousel initially can move the flat cartons in the downstream direction D1 and can open the cartons by positioning the cartons from the flat configuration to the opened configuration with the cells or compartments of the cartons formed and positioned to receive respective containers or articles (e.g., bottles) B. In one embodiment, the opening carousel 3 includes carton opening features that at least partially open the cartons C and that can help transfer the cartons C to the carton loading carousel 5. As described in more detail below, the carton opening features can include a series of opening guides 9 (FIGS. 2-6B) that are inserted into the respective cartons C to open the cartons as the cartons and the guides move in the downstream direction D1. The guide assemblies 9 then move with the opened cartons C through a reorientation region 11 of the first carousel 3 to position the cartons in the upright position. In the illustrated embodiment, the guide assemblies 9 with the respective cartons C can move around a downstream end 12 of the carton opening carousel 3, transitioning from moving in the downstream direction D1 to moving in the upstream direction D2, as the cartons and guides move through the reorientation region 11.

As shown in FIGS. 1 and 2, the upright and opened cartons C with the respective guide assemblies 9 inserted therein are then conveyed to a transfer region 13 where features of the carton opening carousel 3 and the carton loading carousel 5 cooperate to transfer the opened cartons C from the former to the latter. In the illustrated embodiment, the cartons C and the features of the carton opening carousel 3 and the carton loading carousel 5 are moved together in the upstream direction D2 as the cartons C are withdrawn from the guide assemblies 9 of the carton opening carousel 3 onto respective carrier flights 15 (FIGS. 2 and 7) of the carton loading carousel 5 in the transfer region 13. As shown in FIGS. 1 and 2, the carton loading carousel 5 receives the opened cartons C in the respective carrier flight 15, which move the cartons 5 around an upstream end 14 of the transfer region 13, transitioning from moving in the upstream direction D2 to moving in the downstream direction D1, to then transport the cartons under the bottles B in the carton loading carousel 5. The bottles B can be fed to the carton loading carousel 5 from a bottle infeed assembly in a bottle supply S in the downstream direction D1, and the carton loading carousel 5 can at least partially position the bottles B in bottle groups B' (broadly: article groups) for the respective cartons (e.g., bottle groups of a 2×3 configuration for loading into cartons configured for the same). In one embodiment, the carrier flight 15 lifts the carton C up to the underside of the bottle groups B' and the carton loading carousel loads the bottle groups B' through the open top T of the carton so that each container is received in a respective compartment of the respective carton as the cartons C and the bottle groups B' move in the downstream direction D1. The dual carousel system 1 can have other features and/or the features shown can be otherwise shaped, arranged, configured, and/or omitted without departing from the disclosure.

Figure 3:
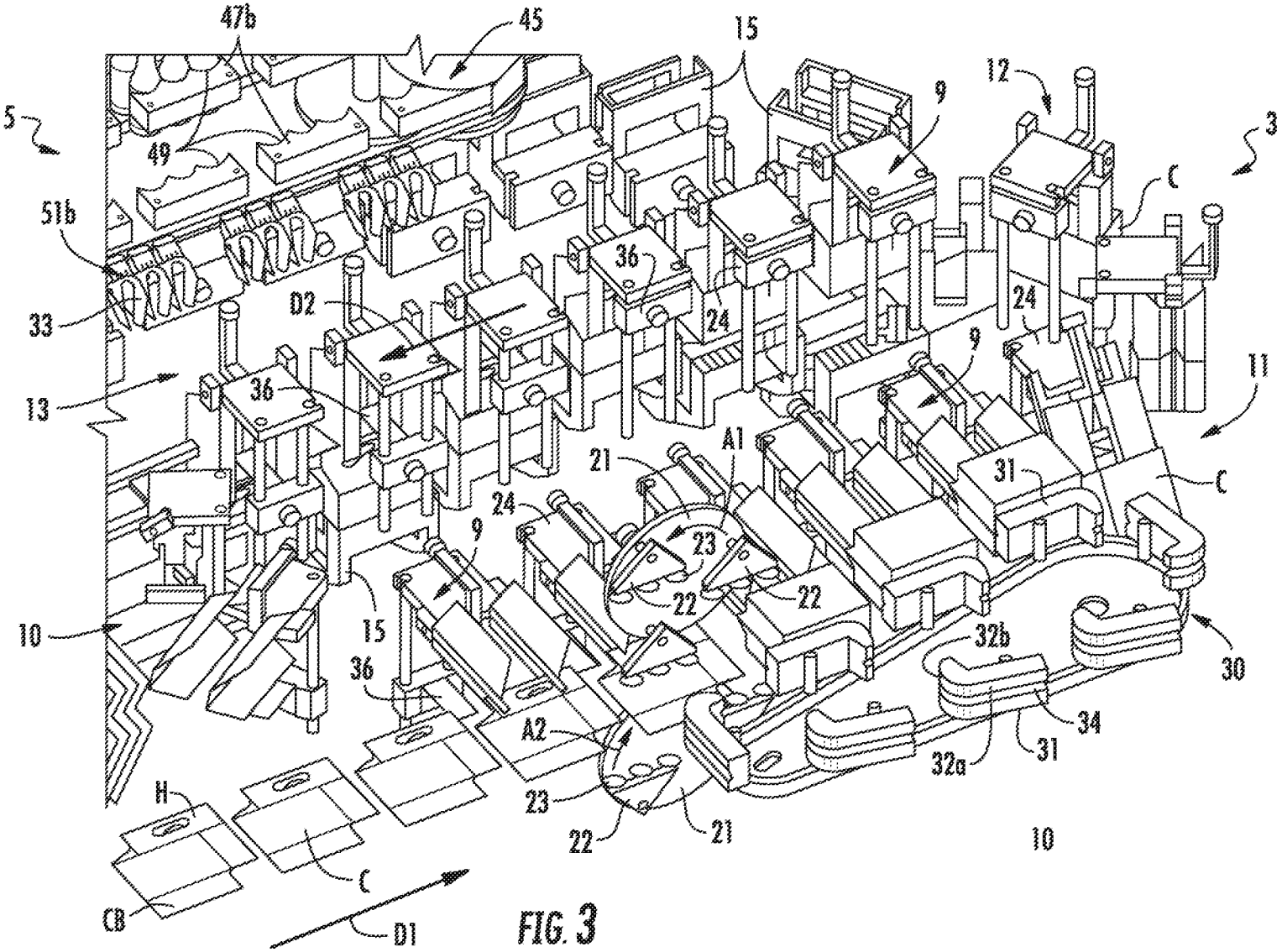
FIG. 3 is a schematic perspective view of a carton opening carousel and transfer region of the system of FIGS. 1 and 2.
Figure 4:
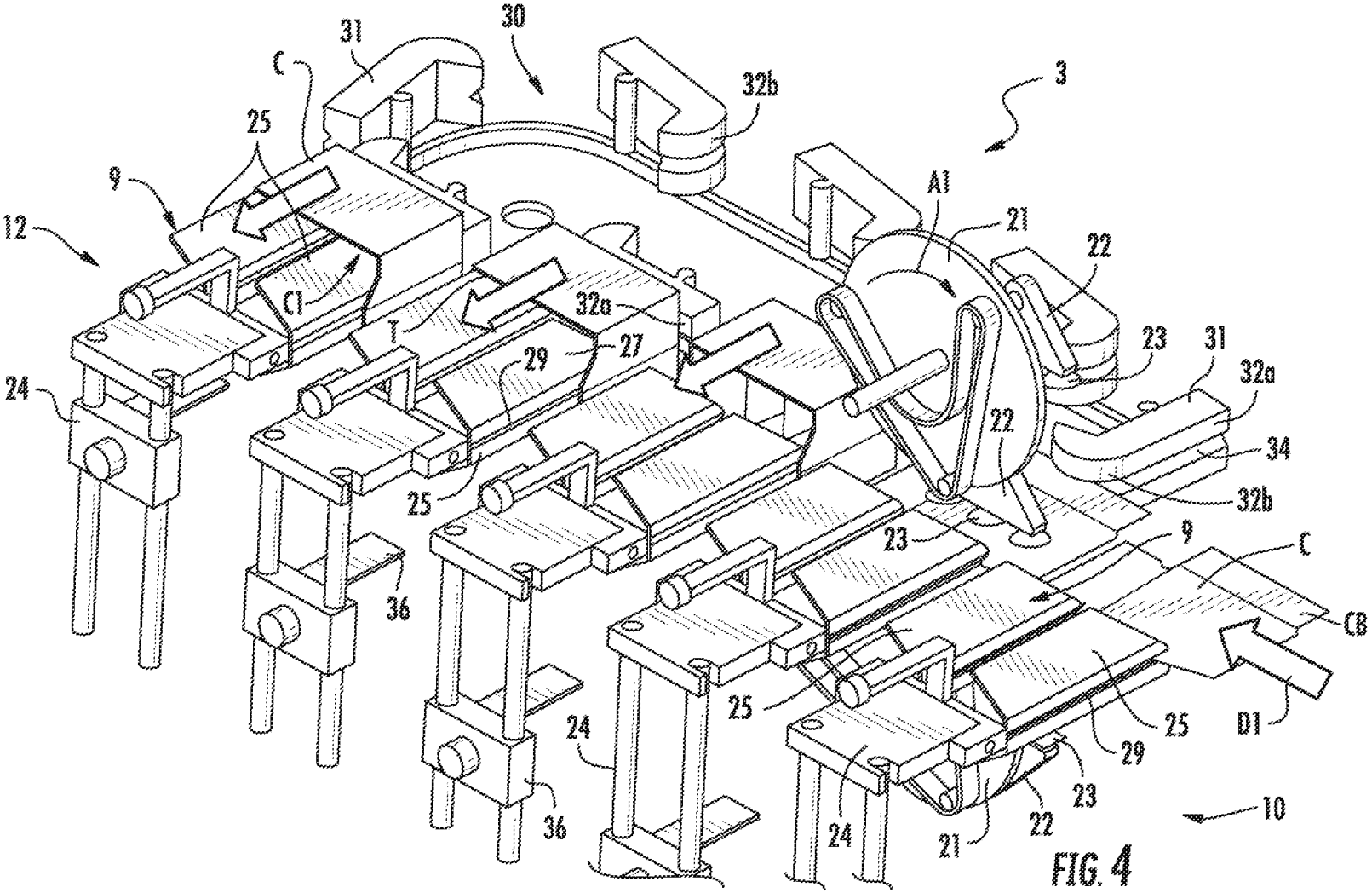
FIG. 4 is a schematic perspective view of a portion of the carton opening carousel of FIG. 3 showing the opening of cartons according to the exemplary embodiment of the disclosure.

The carton opening carousel 3 and the guide assemblies 9 are shown in more detail in FIGS. 3-6B. As shown in FIGS. 3 and 4, the carton opening carousel 3 includes carton opening features including two opposed rotary vacuum heads 21 and the guide assemblies 9. In the illustrated embodiment, each of the rotary vacuum heads 21 includes three actuator arms 22, each having three vacuum cups 23. Alternatively, the rotary vacuum heads 21 can include any suitable number of actuator arms 22 and/or vacuum cups 23. The rotary vacuum heads 21 can rotate in opposite directions, and, in one embodiment, the rotary vacuum heads 21 can rotate in the directions indicated by respective arrows A1, A2 so that the actuator arms 22 are moving in the downstream direction D1 as they engage a respective carton C. For example, the upper rotary vacuum head 21 can rotate counterclockwise as viewed in FIG. 3, and the lower rotary vacuum head 21 can rotate clockwise as viewed in FIG. 3. Accordingly, as the cartons C are moved in the downstream direction D1 into the carton opening carousel 3, respective actuator arms 22 of the upper and lower rotary vacuum heads 21 come together above and below the respective carton C. The vacuum cups 23 of the respective actuator arms 22 can engage respective panels of the carton (e.g., the front panel and the back panel of the respective carton) and can be releasably attached to those panels (e.g., by a suction force). As the rotary vacuum heads 21 continue to rotate in the directions of respective arrows A1, A2 and the carton C continues to move in the downstream direction D1, the actuator arms 22 in engagement with the carton can begin to move away from one another (e.g., the upper actuator arm 22 can move downstream and upwardly, and the lower actuator arm 22 can move downstream and downwardly). Accordingly, the actuator arms 22 can pull on the respective front and back panels of the carton C so that the panels are moved apart from the central wall of the carton, which can include the handle H. In one embodiment, the carton C is folded along its fold lines so that the front and back panels, the end panels, the bottom panel, and the central wall at least partially define the front and back portions of the carton for receiving the bottles B. As the actuator arms 22 are further moved away from one another on the rotary vacuum heads 21 and the cartons C continue to move downstream, the vacuum cups 23 are pulled away from the respective panels and can be released or pulled apart from the respective panels. In one embodiment, the rotary vacuum heads 21 only partially erect the cartons C and provide openings in the cartons C for receiving the guide assemblies 9. The rotary vacuum heads 21 could be otherwise configured without departing from the disclosure. For example, the rotary vacuum heads 21 could fully erect the cartons C.

Figure 5:
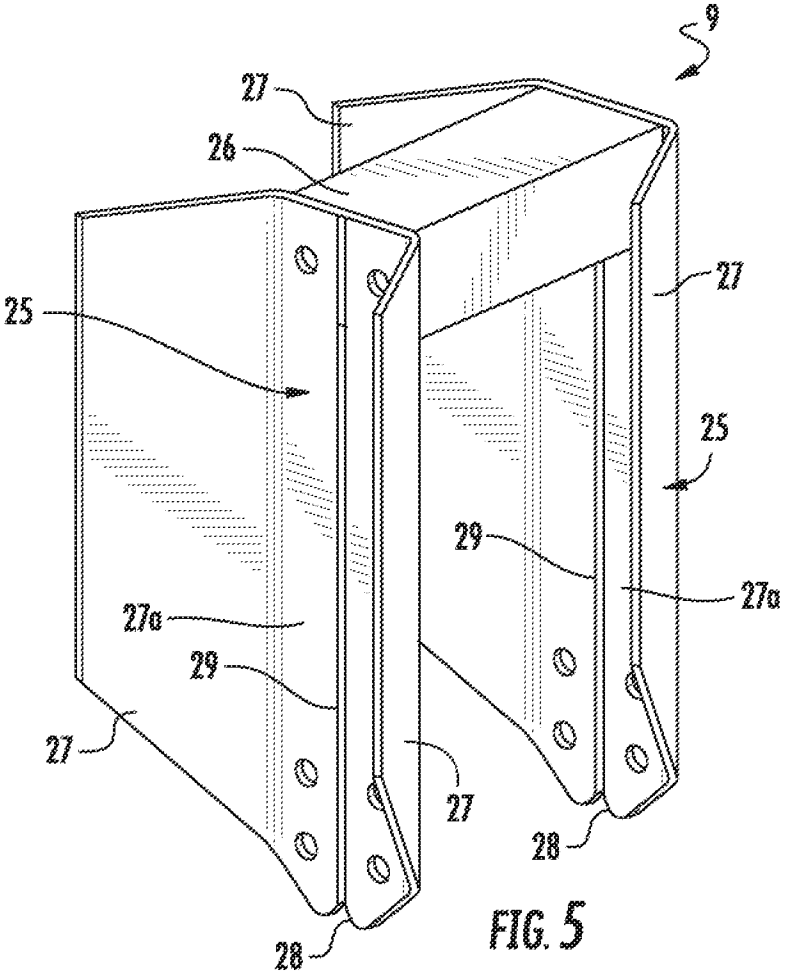
FIG. 5 is a perspective view of a guide assembly of the carton opening carousel of FIG. 3.

As shown in FIGS. 1-3, the guide assemblies 9 can be pivotally mounted on supports 24 and moved on the carton opening carousel 3 (e.g., on a continuous belt, chain, or other conveyor) to engage respective cartons C, further erect the respective cartons, reorient the respective cartons, and transfer the respective cartons to the carton loading carousel 5. As shown in FIG. 5, each of the guide assemblies 9 can include two guide arms 25 mounted to a support member 26. In the illustrated embodiment, each of the guide arms 25 can include two oblique flanges 27 extending obliquely with respect to a central portion 27*a*. Further, each of the guide arms 25 can include a tapered end 28 with a tip disposed opposite to the support member 26 and extending along an edge of the central portion 27*a* and the oblique flanges 27. As shown in FIG. 5, each of the guide arms 25 can also include a central slit 29 extending in the central portion 27*a* for at least partially receiving the handles H and/or the central walls of respective cartons C as the guide arms 25 are inserted into the carton openings. As the guide assemblies 9 are moved around the upstream end of the carton opening carousel 3, the guide assemblies 9 can engage respective cartons C in the flat configuration moving in the downstream direction from the magazine M. As shown in FIGS. 3 and 4, the slits 29 of the two guide arms 25 on one of the guide assemblies 9 can receive the handle H and/or central wall of a respective carton C. The guide assembly 9 and the carton C engaged therewith can continue to move in the downstream direction D1, and the rotary vacuum heads 21 can at least partially open the carton C as described above as the carton passes between the rotary vacuum heads.

In the illustrated embodiment, a pusher assembly 30 can be disposed adjacent the cartons C. As shown in FIGS. 3 and 4, the pusher assembly 30 can include a plurality of pusher lugs 31 mounted on a continuous belt, chain, and/or other conveyor. Each of the pusher lugs 31 can include a generally flat face 32*a* and a curved forward end 32*b*. In the illustrated embodiment, a grove 34 can extend through the face 32*a* and the curved end 32*b* of each of the pusher lugs 31. In one embodiment, as the pusher lugs 31 are moved around the upstream end of the pusher assembly 30, one of the pusher lugs 31 can engage a respective carton C that is passing between the rotary vacuum heads 21 so that the folded base panel CB of the carton is at least partially received in the groove 34 at the curved end 32*b*. As the rotary vacuum heads 21 open the carton from the flat configuration, the pusher assembly 30 can move the pusher lug 31 around to move in the downstream direction and to orient the face 32*a* against the base panel CB of the carton, which can be generally vertical between the front and back panels of the carton in the at least partially open configuration. The pusher assembly 30 can be configured to move the pusher lugs 31 toward the guide assemblies 9 as they are moved downstream to thereby push respective cartons C onto the respective guide assemblies 9. The pusher assembly 30 could be omitted or could be otherwise positioned, arranged, and/or configured without departing from the disclosure. For example, the pusher assembly 30 could be positioned so that the pusher lugs 31 engage the respective cartons C before or after the cartons pass through the rotary vacuum heads 21, and/or the pusher lugs 31 could be alternatively shaped.

Figure 6A:
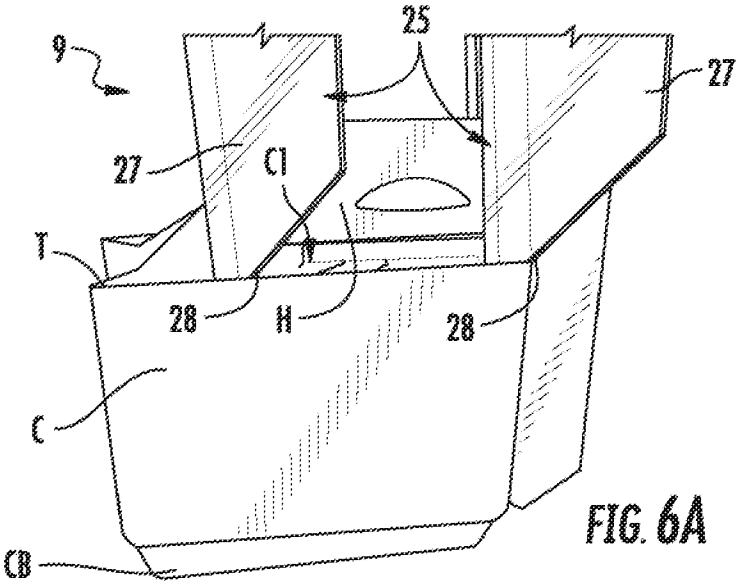
FIGS. 6A and 6B are perspective views showing a guide assembly of FIG. 5 opening a carton according to the exemplary embodiment of the disclosure.
Figure 6B:
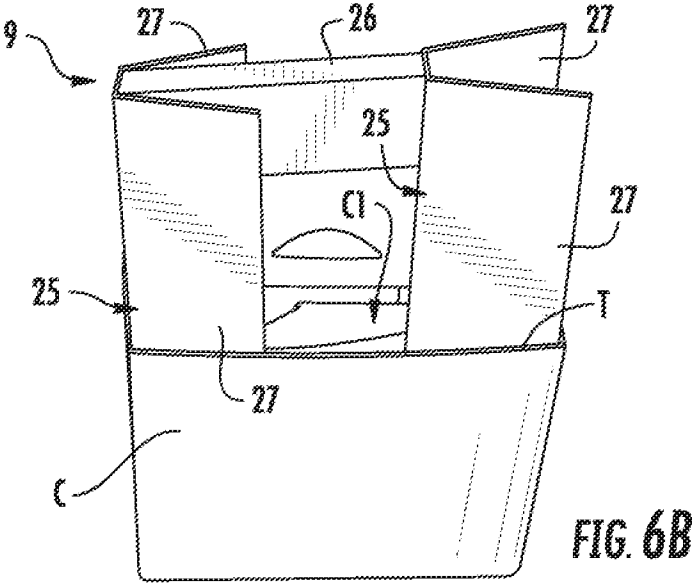

In the illustrated embodiment, as the guide assemblies 9, the cartons C, and the pusher lugs 31 move downstream, the pusher lugs 31 urge the respective cartons toward the guide assemblies 9 so that the guide arms 25 of the respective guide assembly are received in the interior C1 of the carton with the center wall of the carton received in the slits 29 of the guide arms (FIGS. 3 and 4). In one embodiment, the tapered ends 28 of the guide arms 25 of a respective guide assembly 9 can enter the interior C1 of the carton (FIG. 6A) (e.g., as the respective pusher lug 31 urges the carton toward the guide assembly), and the oblique flanges 27 can push the panels of the carton C into the open or erect configuration as the carton is further pushed onto the guide arms 25 (FIG. 6B). The oblique flanges 27 can fit snugly in the interior C1 of the carton C so that the carton is removably retained on the guide assembly 9 as the cartons and the guide assemblies 9 move downstream from the pusher assembly 30 to the reorientation region 11 (FIGS. 2 and 3).

In the illustrated embodiment, the rotary vacuum heads 21 and the guide arms 25 cooperate to erect the cartons C from the flat configuration to the open configuration. Accordingly, the rotary vacuum heads 21 only need to partially separate the front and back panels from the central wall of the carton to provide openings for the tapered ends 28 of the guide arms 25 to enter the cartons on either side of the central wall and engage the interior surfaces of the front and back panels. Any glue spots, unbroken nicks, or other features in the cartons that may resist further opening of the cartons by the rotary vacuum heads 21 can be overcome by the guide arms 25 as the cartons are pushed onto the guide arms, sliding over the tapered ends 28 and the oblique flanges 27. The rotary vacuum heads 21 can be relative compact since a larger vacuum system with multiple heads extending over a distance and requiring multiple vacuum supplies is not needed to fully open the cartons and overcome resistance to opening.

As shown in FIGS. 2 and 3, the guide assemblies 9 can be pivoted on their supports 24 (e.g., due to action by a cam follower moving in a track or an electric, pneumatic, or other suitable actuator) so that the guide arms 25 are moved to a vertical orientation and the carton is in an upright position. Accordingly, the cartons C are moved to an upright position as the cartons are moved through the reorientation region 11 of the carton opening carousel 3. The cartons C can then be moved around the downstream end 12 of the carton opening carousel 3 on the guide assemblies 9. The cartons C could be otherwise opened and/or reoriented without departing from the disclosure.

Figure 7:
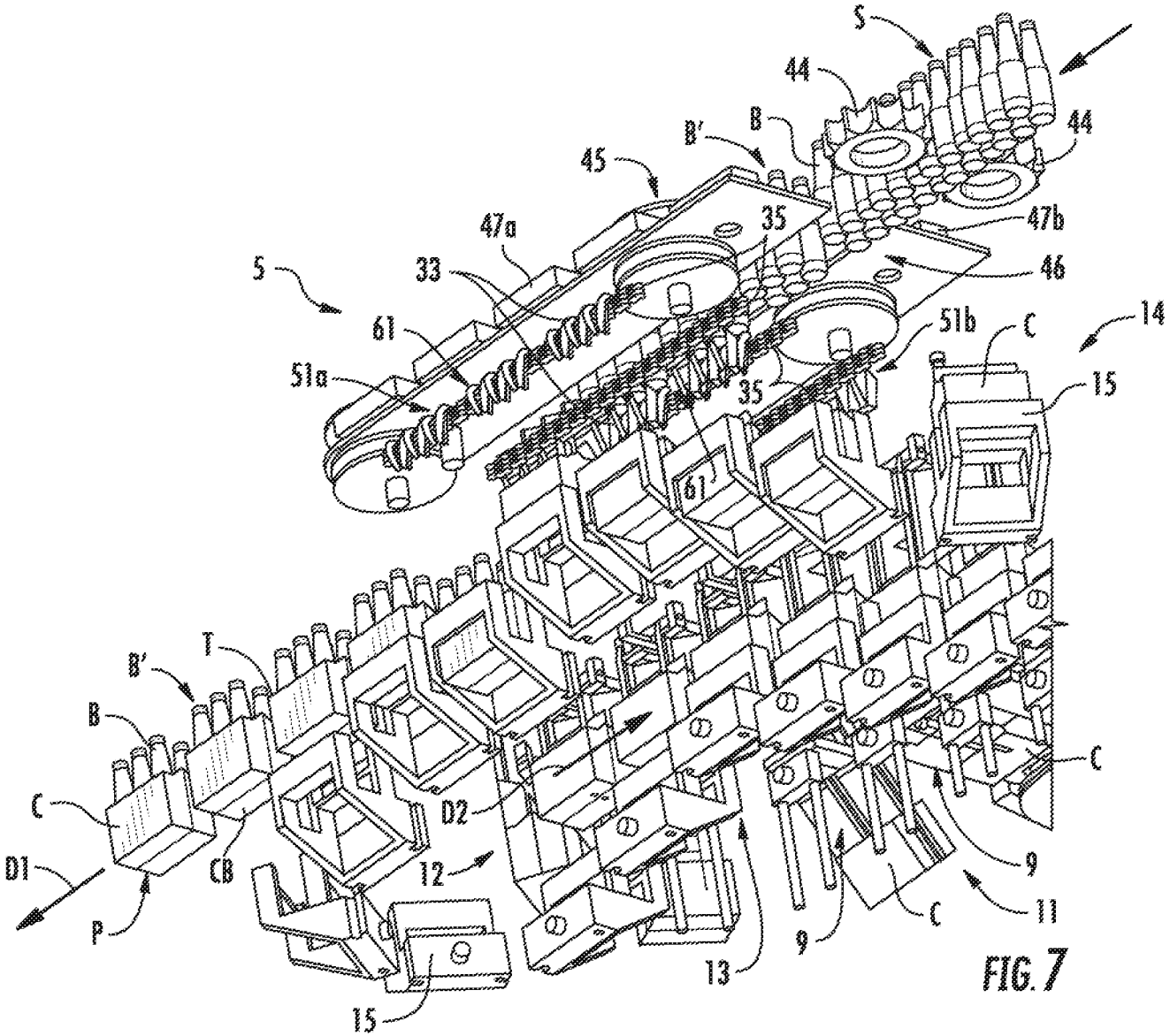
FIG. 7 is a schematic perspective view of a carton loading carousel and the transfer region of the system of FIGS. 1 and 2.

In the illustrated embodiment, as the guide assemblies 9 move with the cartons C held on the guide arms 25 around the downstream end 12 of the carton opening carousel 3, the guide assemblies 9 and the cartons C are moved into the transfer region 13 and begin to move in the upstream direction D2. As shown in FIGS. 2, 3, and 7, the carton loading carousel 5 moves respective carrier flights 15 under the cartons C and the guide arms 25 so that the carrier flights 15 move in the upstream direction D2 under respective cartons. The carrier flights 15 can be moved upwardly (e.g., due to action by a cam follower moving in a track or an electric, pneumatic, or other suitable actuator) to at least partially receive respective cartons in the carrier flights as the cartons, the guide assemblies, and the carrier flights move in the upstream direction D2. The carrier flights 15 then can move downwardly (FIG. 7) (e.g., due to action by the same actuator) while a discharge arm 36 of the guide assembly 9 moves downwardly (e.g., due to action by a cam follower moving in a track or an electric, pneumatic, or other suitable actuator) to urge the carton downwardly off the guide arms 27 (FIGS. 2 and 3). In one embodiment, the discharge arm 36 can be slidably mounted on the support 24 of the respective guide assembly 9. At the upstream end of the transfer region 13, the cartons C can be fully removed from the guide assemblies 9 and received in respective carrier flights 15 to be thereby transferred to the carton loading carousel 5 from the carton opening carousel 3. The guide assemblies 9 can then move around the upstream end 10 of the carton opening carousel 3 while being pivoted upwardly to the horizontal orientation for engaging another carton C in the flat configuration. Additionally, the discharge arm 36 can be reset to its upper position as the cartons are loaded onto the respective guide arms 27 (FIG. 4).

The carton loading carousel 3, including at least the guide assemblies 9 and the rotary vacuum heads 21, could be otherwise arranged, positioned, and/or configured without departing from the disclosure. For example, the guide assemblies 9 could include any suitable number guide arms 25 (e.g., 1 or more guide arms) and/or the guide arms 25 could include any suitable number of oblique flanges (e.g., 1 or more oblique flanges). In the illustrated embodiment, the cartons C are configured for receiving bottles B in a 2×3 configuration. However, other carton configurations could be used. For example, the guide assemblies 9 could be configured for a 2×2 carton configuration wherein each guide assembly includes one guide arm for engaging one 2×2 carton. Alternatively, the guide assemblies 9 each could include 3 or more guide arms 25 for engaging larger cartons (e.g., a 2×5 configuration). In another embodiment, a smaller carton (e.g., in a 2×2 configuration) can be opened by the guide assemblies 9 of the illustrated embodiment (with two guide arms 25 each), wherein each guide arm 25 receives a respective carton so that each guide assembly engages two cartons. The cartons C could be configured for any suitable arrangement of bottles B without departing from the disclosure.

As shown in FIGS. 2 and 7, the carrier flights 15 can be moved with the respective cartons C received therein around the upstream end 14 of the carton loading carousel 5 to then move in the downstream direction D1 under a bottle handling assembly 45 (broadly: article handling assembly). In the illustrated embodiment, the bottles B can be fed to the bottle handling assembly 45 (e.g., on a belt or other suitable conveyor) so that the bottles B move in the downstream direction D1 in a central region 46 of the bottle handling assembly. In one embodiment, the bottle handling assembly 45 can include features for grouping the bottles B into the bottle groups B' and guiding the bottles into the respective cartons C as the cartons are moved under the bottle handling assembly. As shown in FIG. 2, the features for grouping the bottles B can include star wheels 44 and guide blocks 47*a*, 47*b* moved on respective conveyors (e.g., an endless belt, chain, or other suitable conveyor) so that they move together in the downstream direction D1 in the central region 46 of the bottle handling assembly. Each of the guide blocks 47*a*, 47*b* can include indents 49 for engaging respective bottles B. For example, the illustrated cartons C are configured for bottles B in a 2×3 arrangement. Accordingly, in the exemplary embodiment, the bottles B can be fed in two rows and each of the guide blocks 47*a*, 47*b* can include three indents 49 for forming a bottle group B' in a 2×3 arrangement. The cartons C could be configured for any suitable arrangement of bottles B and/or the guide blocks 47*a*, 47*b* could include any suitable number of indents 49 without departing from the disclosure.

Figure 8:
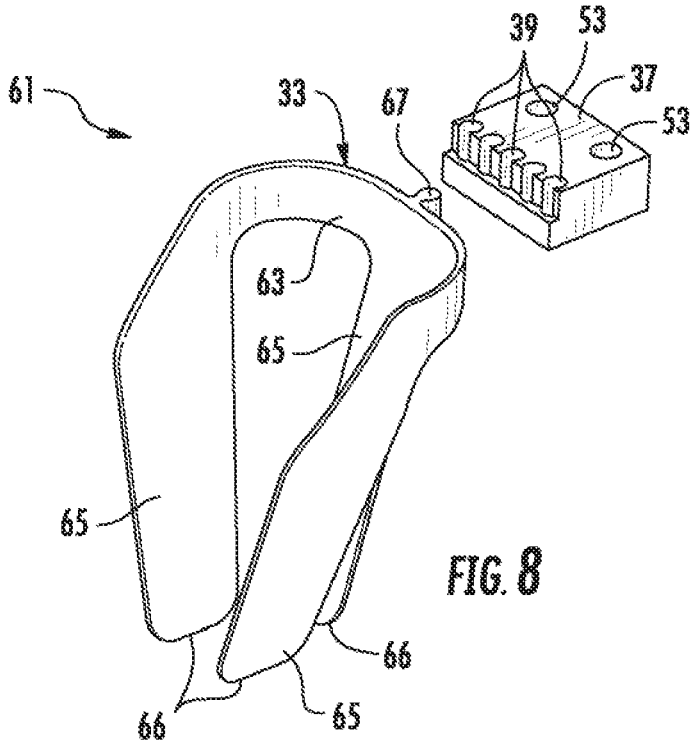
FIGS. 8 and 9 are perspective views of a loading lug assembly of the carton loading carousel of FIG. 7.
Figure 9:
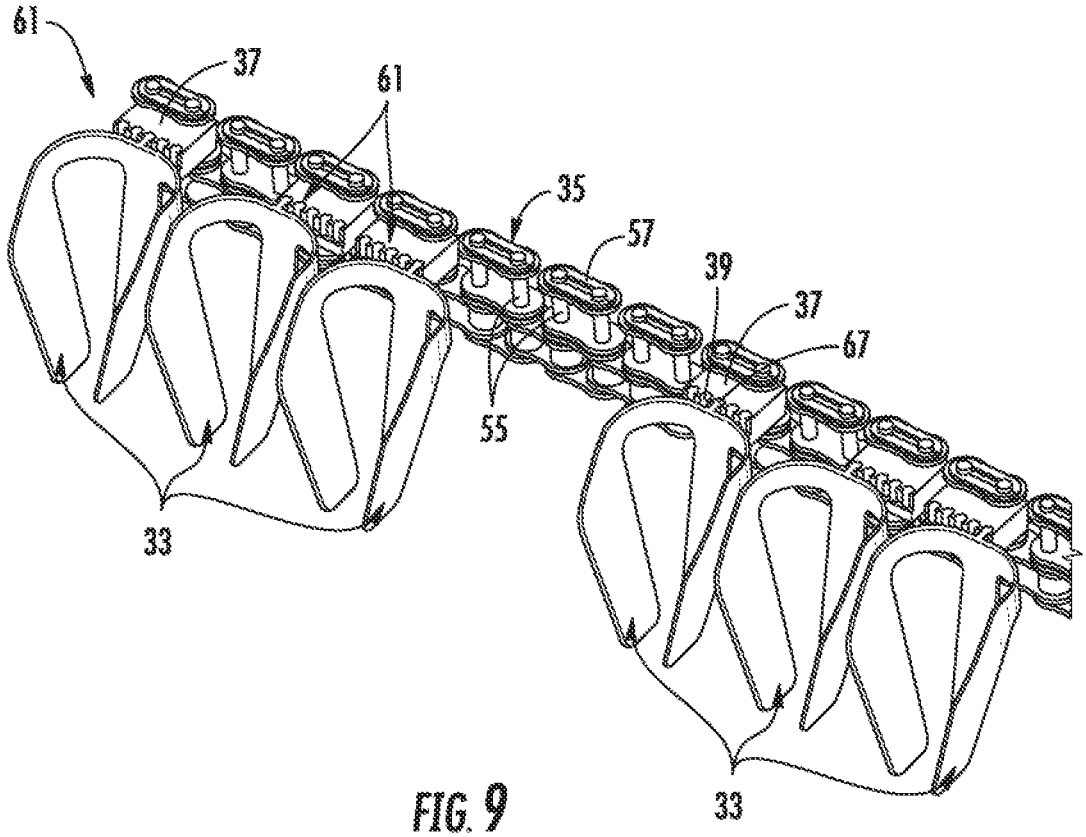

In the illustrated embodiment, the bottle handling assembly 45 further can comprise two loading lug conveyors 51*a*, 51*b* disposed on either side of the central region 46 of the bottle handling assembly. The loading lug conveyors 51*a*, 51*b* can be disposed generally below the guide blocks 47*a*, 47*b* and above the carrier flights 15. Each of the loading lug conveyors 51*a*, 51*b* can include a plurality of loading lug assemblies 61 mounted to a drive chain 35 (FIGS. 7-9). The drive chains 35 can be endless chains driven by one or more sprockets or wheels (not shown) or another suitable conveyor, though only portions of the chains 35 are shown in FIGS. 7 and 9 for clarity. As shown in FIG. 8, each of the loading lug assemblies 61 can include a loading lug 33 and a mounting attachment 37. In the illustrated embodiment, the mounting attachment 37 can include two bores 53 for receiving respective mounting posts 55 on the drive chain 35 (FIG. 9). The drive chain 35 can include caps 57 or other suitable fasteners for helping to retain the mounting attachment 37 on the respective mounting posts 55. The caps 57 can be removable for relocating the loading lug assemblies 61 (e.g., adjusting the positioning of the loading lug assemblies 61 along the chain 35) and/or for replacing the loading lug assemblies on the chain (e.g., for repairs).

Figure 10A:
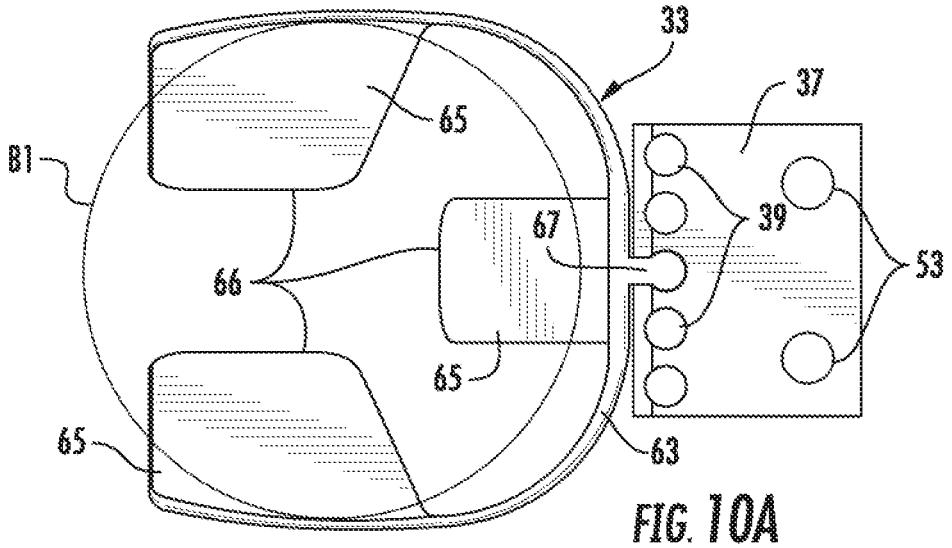
FIGS. 10A and 10B are top views of the loading lug assemblies of FIGS. 8 and 9.

As shown in FIG. 8, the loading lug 33 can include a generally U-shaped crossmember 63 and three fingers 65 extending generally downwardly from the common crossmember 63. In the illustrated embodiment, the loading lug 33 is monolithic (e.g., the fingers 65 are continuous and integral with the crossmember 63). In one embodiment, the loading lug 33 can be made of a generally resilient, flexible material (e.g., plastic and/or metal) with a coefficient of elasticity selected so that the fingers 65 and/or the crossmember 63 can bend inwardly and/or outwardly with some resistance and the loading lug 33 tends to return to its original shape after bending. As shown in FIGS. 8 and 10A, the fingers 65 can be angled inwardly from the crossmember 63 to their respective bottom ends 66. Accordingly, a bottle B moving downwardly through the loading lug 33 can pass the crossmember 63 and engage the fingers 65. As the bottle moves downwardly, the bottle can urge one or more of the fingers 65 to bend outwardly. In one embodiment, the tendency of the fingers to return to their original positions can cause the fingers to drag against the bottles somewhat and help slow the downward motion of the bottles. The fingers 65 can also help resist lateral movement of the bottles B. Since, in the illustrated embodiment, the fingers 65 are unitary with the crossmember 63, the loading lug 33 can have a generally smooth inner surface with little or no features for catching on the bottles and or the bottle labels.

As shown in FIG. 8, the loading lug 33 can include a mounting projection 67 extending from the crossmember 63 for engaging a selected slot 39 in the mounting attachment 37. In one embodiment, the mounting projection 67 can snap into the selected slots 39 so that the loading lug 33 is removably secured to the mounting attachment 37. The loading lug assembly 61 could be otherwise shaped, configured, arranged, and/or positioned without departing from the disclosure. For example, the loading lug 33 could be otherwise mounted to the mounting attachment 37 and/or the mounting attachment 37 could be otherwise mounted to the drive chain 35. In another example, more than one loading lug 33 can be mounted to a single mounting attachment 37 (e.g., the mounting attachment 37 could be longer and the mounting projections 67 of two loading lugs can engage respective slots 39 in the mounting attachment).

Figure 10B:
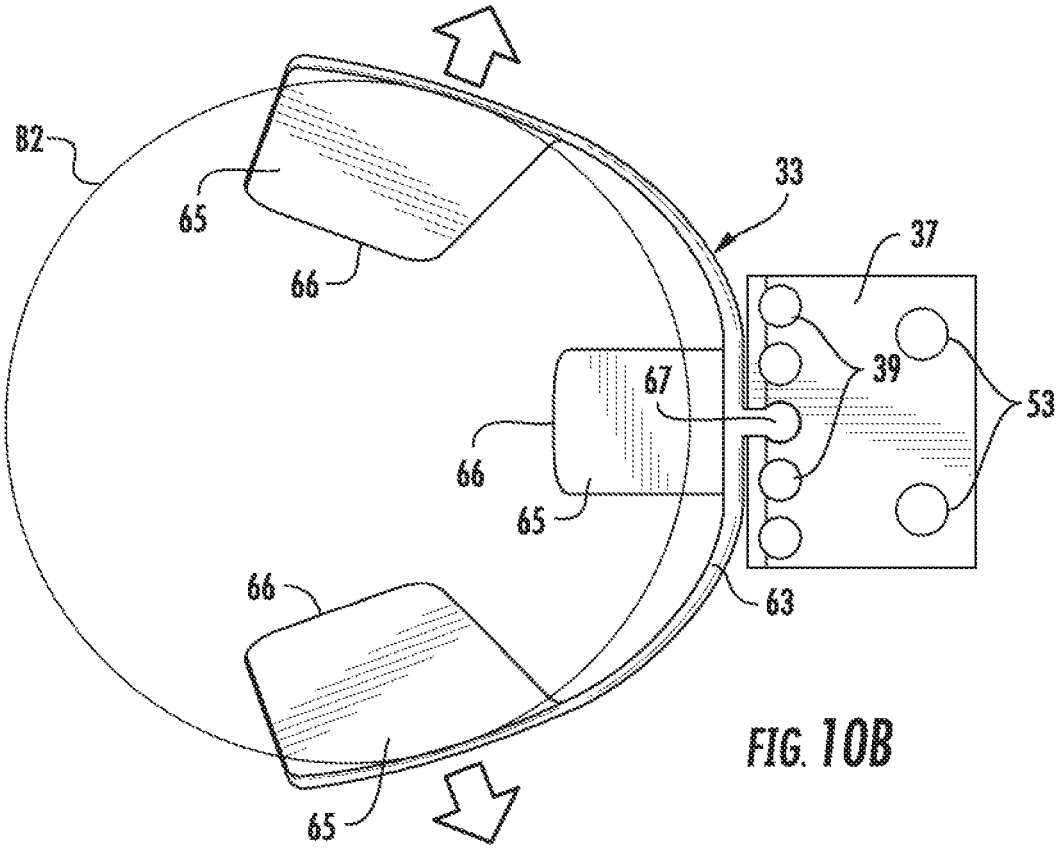

In the illustrated embodiment, the flexibility of the loading lugs 33 and the adjustability of the connection between the loading lug and the mounting attachment 37 and between the mounting attachment and the drive chain 35 can help the loading lug assembly 61 accommodate articles having different sizes (e.g., diameters). For example, a bottle B1 having a relatively small diameter (shown schematically in FIG. 10A) can slide past the crossmember 63 and engage the inwardly angled fingers 65 as the bottle B1 is lowered into a carton C via the loading lug 33. In another example, a bottle B2 having a relatively large diameter (shown schematically in FIG. 10B) can cause the crossmember 63 to bend outwardly and then engage the inwardly angled fingers 65 as the bottle B2 is lowered into a carton C via the loading lug 33. The spacing between the loading lugs 33 on the drive chain 35 also can be adjusted to account for the article diameter. For example, the mounting attachments 37 can be positioned farther apart on the drive chain 35 and/or the mounting projections 67 of the respective loading lugs 33 can be engaged with spaced slots 39 in the respective mounting attachments 37 to accommodate an article with a relative large diameter (e.g., bottle B2).

As shown in FIG. 9, the loading lug assemblies 61 can be arranged in groups on the drive chain 35, and the groups can correspond to the bottle groups B'. For example, where the cartons C are configured for receiving bottles B in a 2×3 arrangement (e.g., each carton C has two rows of three cells, and the two rows can be a front row and a back row), the loading lug assemblies 61 can be arranged in groups of three on the drive chain 35 for each of the loading lug conveyors 51*a*, 51*b*. Accordingly, the movement of the drive chains 35 and the spacing of the groups of loading lug assemblies 61 in each of the loading lug conveyors 51*a*, 51*b* can be configured so that as the loading lugs 33 are moved in the central region 46 of the bottle handling assembly 45, the groups of loading lug assemblies 61 of the two loading lug conveyors 51*a*, 51*b* are brought together and aligned. The aligned groups of loading lug assemblies 61 can be generally vertically aligned with a respective bottle group B' above and a respective carton C below so that each of the loading lugs 33 is aligned with a respective bottle B and a respective cell in the carton C as the bottles B, the carton C, and the loading lugs 33 are moved in the downstream direction D1 with the carton loading carousel 5. The loading lug conveyors 51*a*, 51*b* could be otherwise arranged, configured, and/or positioned without departing from the disclosure. For example, the groups of loading lug assemblies 61 could have any suitable number of loading lug assemblies.

Figures 11A, 11B, 11C, 11D, 11E:
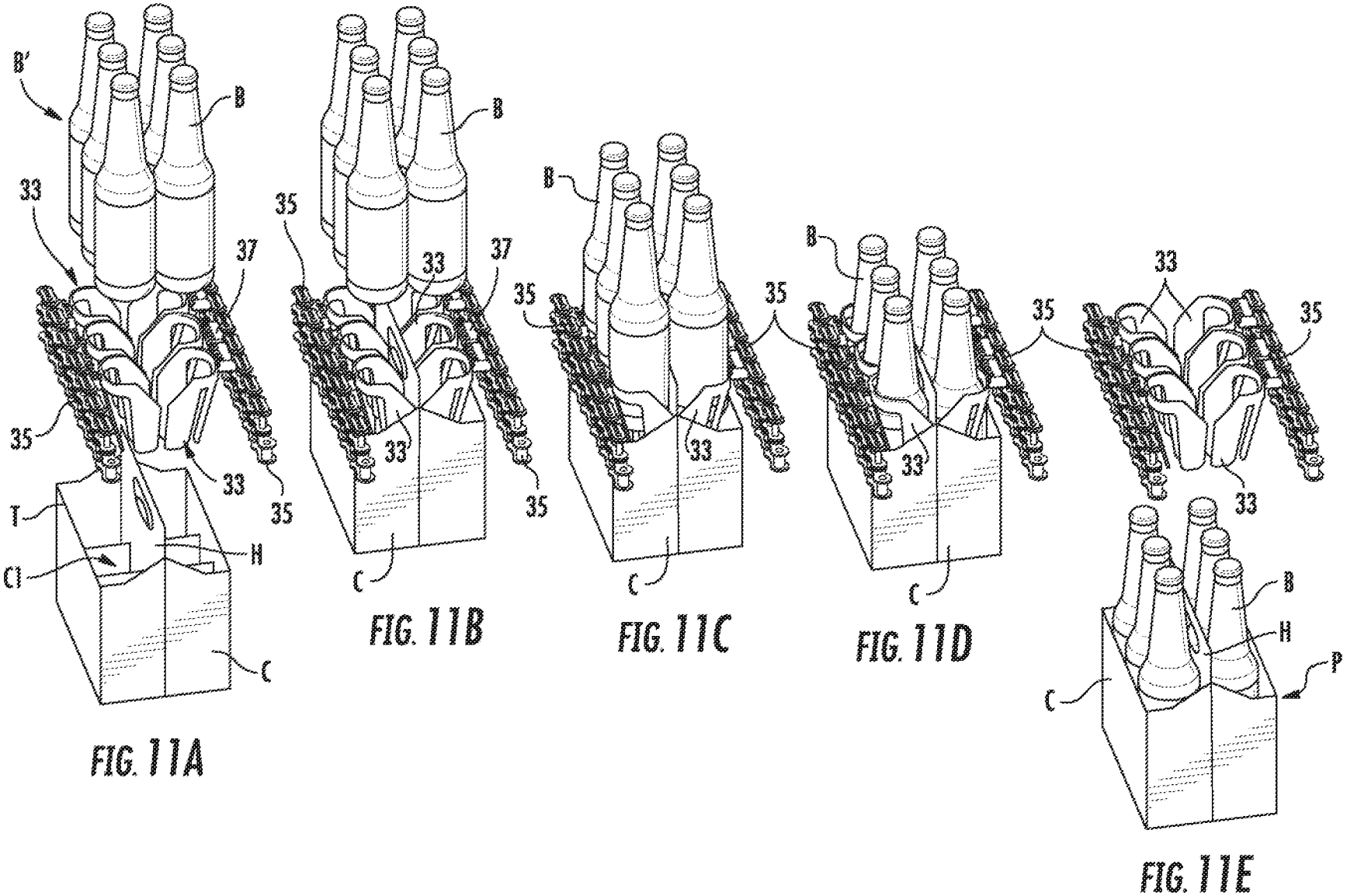
FIGS. 11A-11E are perspective views schematically showing the loading of the bottles into the cartons according to the exemplary embodiment of the disclosure.
Figure 12B:
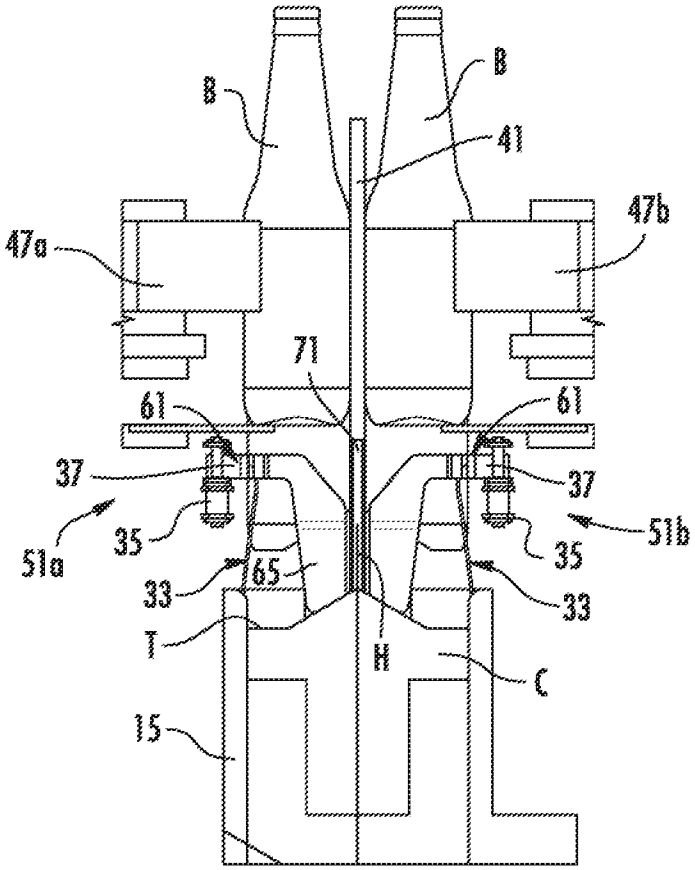
FIGS. 12A and 12B are end views schematically showing the loading of the bottles into the cartons according to an embodiment of the disclosure.
Figure 12A:
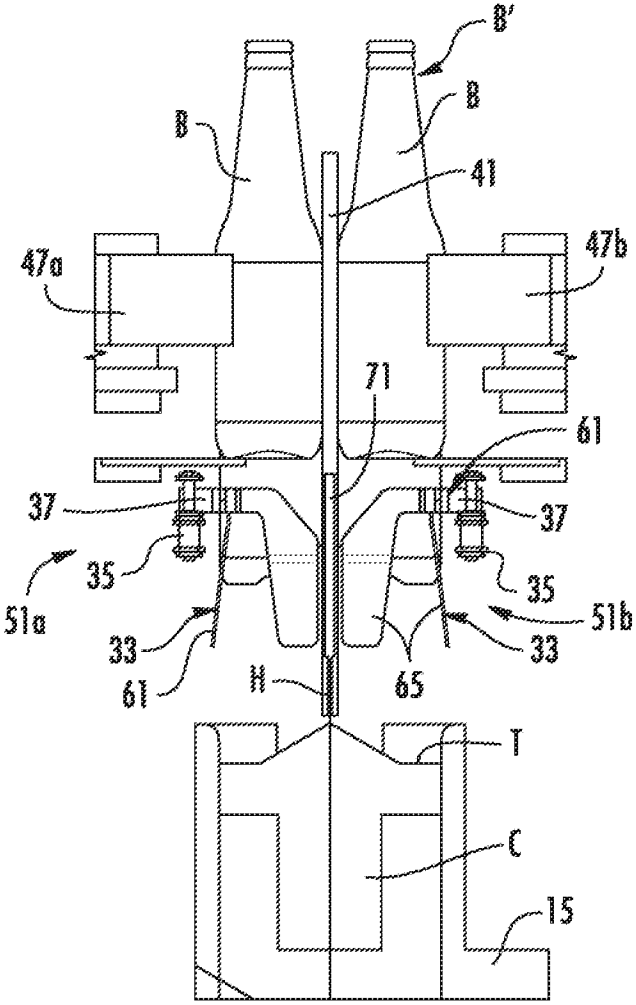

In operation, the bottles B can be arranged into the bottle groups B' and loaded into the cartons C as shown in FIGS. 2 and 7. For example, as the bottles B in the bottle supply S enter the central region 46 of the bottle handling assembly 45, two guide blocks 47*a*, 47*b* are moved around the upstream end of their respective conveyors, are brought together in the central region 46, and engage bottles in the bottle supply S with respective indentations 49. The opposed guide blocks 47*a*, 47*b* and/or a conveyor (e.g., a conveyor belt or a guide plate; e.g., as shown in FIGS. 12A and 12B) can move the engaged bottles B downstream in the central region 46 away from the remainder of the bottles in the bottle supply S to form a bottle group B'. A group of loading lug assemblies 61 on each of the loading lug conveyors 51*a*, 51*b* is brought around the upstream end of the respective loading lug conveyors 51*a*, 51*b*. The two groups of loading lug assemblies 61 can be brought together under the bottle group B' and the associated guide blocks 47*a*, 47*b* so that the loading lugs 33 are generally vertically aligned with the respective bottles B. Additionally, a carton C can be carried by a respective carrier flight 15 under the bottle group B' and the loading lugs 33 so that the cells of the carton are generally vertically aligned with the respective loading lugs 33 and bottles B (FIGS. 7 and 11A). In the illustrated embodiment, as the carton C, the bottles B, and the loading lugs 33 move in the downstream direction, the carton C can be moved upwardly by the carrier flight 15 (e.g., due to action by a cam follower moving in a track or an electric, pneumatic, or other suitable actuator) so that the loading lugs 33 are received in the interior C1 of the carton C through the open top T of the carton (FIGS. 7 and 11B). In one embodiment, each of the loading lugs 33 can be at least partially received in a respective cell of the carton.

As shown in FIGS. 7, 11C, and 11D, as the carton C, the bottles B, and the loading lugs 33 continue to move in the downstream direction D1, the bottle group B' can be lowered so that each bottle B is received in a respective loading lug 33 (e.g., by moving the guide blocks 47*a*, 47*b* apart and/or by removing a guide plate or conveyor belt). As the bottles B move downwardly in the loading lugs 33, the loading lugs can guide the bottles into respective cells of the carton C. Additionally, the bottles can engage the fingers 65 and/or the crossmember 63 of the respective loading lugs 33 and cause the fingers and/or the crossmember to bend outwardly. Accordingly, the fingers 65 of the loading lugs 33 can help slow the downward movement of the bottles B and help prevent the bottles from falling too forcefully into the carton C. Stated another way, the loading lugs can help reduce breakage of the bottles by helping to control their descent into the carton. As shown in FIGS. 7 and 11E, as the carton C, the bottles B, and the loading lugs 33 continue to move in the downstream direction, the carton C can be lowered on the carrier flight 15 (e.g., due to action by a cam follower moving in a track or an electric, pneumatic, or other suitable actuator). As the carton is lowered, the loading lugs 33 are withdrawn from the interior C1 of the carton and the bottles B remain in the carton. In one embodiment, the cartons C loaded with bottles B form respective packages P that can be removed from the respective carrier flights 15 and discharged from the system 1 (FIGS. 1, 2, and 7). As shown in FIGS. 2 and 7, the empty carrier flights 15 can be moved around a downstream end of the carton loading carousel to the transfer region 13, and the loading lug assemblies 61 and the guide blocks 47*a*, 47*b* can be moved around the downstream end of the bottle handling assembly 45 and returned to the upstream end of the bottle handle assembly for loading additional bottles B into respective cartons C. The bottles B could be otherwise loaded into the cartons C without departing from the disclosure.

As shown in FIGS. 12A and 12B, the bottle handling assembly 45 can include a bottle grouping guide 41 disposed between the two rows of bottles B. In the illustrated embodiment, the bottle grouping guide 41 separates the bottles for the front and back cells of the carton C and engages the handle H of the carton C in a slot 71 to locate the carton in the correct alignment with the bottles. As the carton C is raised to receive the loading lugs 33 as shown in FIG. 12B, the handle H is further inserted into the slot 71. The bottle grouping guide 41 could be omitted or otherwise configured without departing from the disclosure.

In the illustrated embodiment, the dual carousel packaging system 1 can be generally compact with a reduced footprint relative to other systems for opening and loading cartons (e.g., single carousel systems). Additionally, it also can be beneficial that, since the upstream end 10 of the carton opening carousel 3 is adjacent the upstream end 14 of the carton loading carousel 5, the bottles B and the cartons C are fed into the system 1 from the upstream end of the system. The upstream feeding of the bottles and the cartons in combination with the overlapping of the carton opening carousel 3 and the carton loading carousel 5 in the transfer region 13 can help provide a relatively small and efficient carton opening and loading system according to one embodiment.

Cartons according to the present disclosure can accommodate articles of any shape. For the purpose of illustration and not for the purpose of limiting the scope of the disclosure, the following detailed description describes beverage containers (e.g., glass beverage bottles) as disposed within the carton embodiments. In this specification, the terms "inner," "interior," "outer," "exterior," "lower," "bottom," "upper," and "top" indicate orientations determined in relation to fully erected and upright cartons.

The present invention is suitable for loading a variety of articles in a variety of containers. Suitable articles include, for example, bottles as shown in the drawings, cans or similar articles. Suitable containers can include, for example, paperboard cartons and basket type containers or carriers. The containers used with the packaging system can include, for example, a glued base, locking tabs, and/or other types of carton closures. The packaging system further can utilize existing style basket containers or can operate with alternative base hole patterns for engagement by a transport conveyor.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments that are within the scope of the claims. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A guide assembly for at least partially opening and conveying a carton, the guide assembly comprising:

a support member;

a first guide arm; and a second guide arm spaced from the first guide arm by the support member, each of the first guide arm and the second guide arm comprising a tapered end that is spaced apart from the support member, at least one flange extending obliquely from a central portion of the respective first guide arm and second guide arm, and a slit extending in the central portion for at least partially receiving a respective portion of the carton, the tapered end comprising an oblique edge extending along at least a portion of the central portion and the at least one flange, wherein, for each of the first guide arm and the second guide arm, the slit extends from the tapered end of the respective first guide arm and second guide arm, and wherein the central portions of the first guide arm and the second guide arm are mounted to the support member so that the central portions of the first guide arm and second guide arm are parallel to one another; wherein the guide assembly is pivotably mounted on a support.

2. The guide assembly of claim 1, wherein, for each of the first guide arm and the second guide arm, the at least one flange comprises at least a first flange and a second flange respectively extending from the central portion, and the first flange and the second flange are spaced apart from one another by the central portion and extend away from one another.

3. The guide assembly of claim 2, wherein, for each of the first guide arm and the second guide arm, the edge of the tapered end extends along at least a portion of the first flange and the second flange.

4. The guide assembly of claim 2, wherein, for each of the first guide arm and the second guide arm, each of the first flange and the second flange is oblique with respect to one another.

5. The guide assembly of claim 1, wherein the at least one flange comprises at least two oblique flanges extending on each of the first guide arm and the second guide arm.

6. The guide assembly of claim 1, wherein the central portions of the first guide arm and the second guide arm are spaced apart from one another in a direction that is perpendicular to the central portions.

7. The guide assembly of claim 1, wherein, for each of the first guide arm and the second guide arm, the at least one flange comprises at least a first flange and a second flange respectively extending from the central portion, and wherein the support member extends between the first flange and the second flange of at least one of the first guide arm and the second guide arm so that the first flange and the second flange are on opposite sides of the support member.

* * * * *